US007335076B2

(12) United States Patent
Hull

(10) Patent No.: US 7,335,076 B2
(45) **Date of Patent: *Feb. 26, 2008**

(54) SWIM TRAINING FIN

(76) Inventor: Martin Philip Hull, 125 Johnson Rd., Port Angeles, WA (US) 98363

( * ) Notice: Subject to any disclaimer, the term of this patent is extended or adjusted under 35 U.S.C. 154(b) by 0 days.

This patent is subject to a terminal disclaimer.

(21) Appl. No.: 11/236,302

(22) Filed: Sep. 26, 2005

(65) Prior Publication Data

US 2007/0072497 A1 Mar. 29, 2007

Related U.S. Application Data

(63) Continuation of application No. 10/213,936, filed on Aug. 6, 2002, now Pat. No. 6,979,241.

(51) Int. Cl.
*A63B 31/08* (2006.01)

(52) U.S. Cl. ..... 441/64

(58) Field of Classification Search ..... 441/64
See application file for complete search history.

(56) References Cited

U.S. PATENT DOCUMENTS 5,709,575 A * 1/1998 Betrock ..... 441/64
6,979,241 B2 * 12/2005 Hull ..... 441/64
2004/0029465 A1 * 2/2004 Hull ..... 441/64

FOREIGN PATENT DOCUMENTS

WO WO0185266 * 11/2001

* cited by examiner

*Primary Examiner*—Stephen Avila
(74) *Attorney, Agent, or Firm*—Peninsula IP Group; Douglas A. Chaikin

(57) ABSTRACT

Disclosed herein is a training fin for assisting a wide variety of swimmers to gain a superior cardiovascular workout with minimal risk of injury. The fin has a proximal end and a distal end. Additionally, the fin has a dorsal section and a plantar section and defines an opening for insertion of a user's foot adjacent the proximal end. The dorsal section has proximal and distal ends aligned with the proximal and distal ends of the fin. The dorsal section is solid from the proximal to distal ends. The dorsal section has side sections. The plantar section has proximal and distal ends aligned with the proximal and distal ends of the fin and dorsal section. The dorsal and plantar sections are joined, at least, at the proximal and side sections. The dorsal surface includes a fluid separator for increasing hydrodynamic design and function. In an exemplary embodiment, the fin defines a boot, made from pliable material. The pliable material being of varying thicknesses. The boot has a foot pocket and a blade portion. The foot pocket is sized and shaped for removable attachment to the foot. The blade portion is sized and shaped for swim training purposes and for transmitting propulsive forces created by a swimmer's leg to the foot and fin. The blade portion has a defined thickness. And, the foot pocket has a constant thickness and being thinner than the thickness of the blade portion.

28 Claims, 6 Drawing Sheets

SWIM TRAINING FIN

This application is a continuation of U.S. patent Ser. No. 10/213,936, now issued as U.S. Pat. No. 6,979,241 B2 filed Aug. 6, 2002.

BACKGROUND OF THE INVENTION

CROSS REFERENCE TO PREVIOUS PATENTS

The inventor herein is also the inventor of swim training fins set forth in U.S. Pat. No. 4,948,385 ("the '385 patent") and U.S. Pat. No. 5,108,328 ("the '328 patent")

1. Field of the Invention

This invention relates to exercise devices for humans and, more particularly to a swim training devices, wherein the user wears the footwear of this invention to increase and maintain their cardiovascular condition and to train competitively for swimming events. The swimming fin of the instant invention provides a swim training fin similar in theory to the earlier and highly successful swim training fins of the '385 patent and the '328 patent, referenced above. However, this device uses a novel and aesthetically pleasing hydrodynamic streamlined design for increasing human efficiency and providing superior training and cardiovascular results.

2. Previous Art

As noted above, this inventor's, Dr. Hull's, prior devices have been highly successful in aiding and facilitating swimming and cardiovascular training. Dr. Hull's above two fins represent major breakthrough in swim training and, in fact created a whole new category of fin, called a swim "training fin". Not only was the fin successful from a training point of view, but also it has been a commercial success.

The fins of the above referenced patents made possible the practicing of swimming at race pace without having to endure the potential injury producing stresses experienced at race pace. This is especially important in preserving the shoulder joints and muscle of swimmers while enabling them to establish the necessary coordination and superior levels of cardiovascular conditioning. The fins of the above referenced patents are instrumental in assisting and facilitating many swimmers, including world class and Olympians, to achieve their personal best, including world records.

Through observation, it has been found that ankle range of motion is a primary determiner of the proficiency of a swimmer. The average person does not swim proficiently because of this lack of ankle range of motion. The average person is substantially less proficient at swimming as compared with walking or running. Ordinarily, a person's legs develop primarily for use on land, i.e. walking or running. Most people are not able to effectively transfer to the water the abundant leg power they enjoy on land. The ability to transfer leg power to the water is dependent on the ability of the foot to deflect or displace water off the end of the foot in a rearward direction. This ability is dependent on the forward range of motion of the foot at the ankle (plantar flexion).

If all other attributes are equal (i.e. foot size, foot shape, leg length and strength), an ankle range of motion of less than 60° results in an average level of swimming proficiency. The farther this range is below 60°, the less proficient the individual will be.

Almost without fail, an individual who posses ankle range of motion of at least 60° will be an above average swimmer. An ankle range of motion of 60° or more is not common. The dorsal surface of this swimmer's foot with this ankle range of motion will deflect water backward during a substantial portion of the kicking movement.

An elite swimmer will have an ankle range of motion past 60°. Typically, there are few who possess ankle range of motion as much as 70° to 75°. These individuals are able to achieve world record status. Previous swim training fins were found to work well for the uncommon person possessing an ankle range of motion of at least 60°.

A training fin is a fin which includes a boot portion and compared with other fins, a shorter blade. The training fin is characterized by its ability to enable a user to practice swimming at steady fast pace, such as a race pace without having to endure the potential injury producing stresses experienced at race pace. Also, a fin to be categorized as a swim training fin must allow the user to get an advantage by its use. For example, if a fin, even though having a short blade does not provide the user with an advantage for its use then it is not a true swim training fin. A training fin must in more technical terms provide for a net gain between propulsion versus the drag created by the fin and its usage.

By definition a swim training fin must have a certain amount of hydrodynamic structure to it. Early fin structures, such as the inventor's herein, provided a substantial number of swimmers with an advantage for its use. Thus, for these swimmers, the earlier training fins provided a net increase in propulsion as a result of its use.

To derive optimum benefit from the earlier fins, the suggested range of ankle motion was 60° or more. Through observation it has been noted that the earlier training fins were not as effective for swimmers having ankle range of motion of less than 60°. As a result of the success of the earlier fins, the desire to make the fins more usable for more users became stronger. The clear problem was that while the fin design worked extremely well for the category of swimmers having an ankle range of motion of at least 60°, a large portion of those desiring such a device could not use the earlier fins successfully or generate the desired efficiency. Thus, the inventor was faced with changing the design of a highly effective and popular fin to accommodate for persons with less range of ankle motion. However, it would be unacceptable to do this at the cost of the popularity for the training fin's initial audience. A complete redesign was necessary, while preserving the principles set forth above.

SUMMARY AND OBJECTS OF THE INVENTION SWIM

It is an object of the present invention to provide a training fin that is effective for a substantial majority of the swimming population.

It is an object of the present invention to provide a swim training fin with superior hydrodynamic characteristics for reducing the drag created as the fin travels through water.

It is an additional object of the present invention to provide a basic new swim training fin design which upon on only slight modification can be adapted for swimmers with varying degrees of ankle range of motion.

It is an additional object of the present invention to provide a swim training fin which is substantially enclosed in one embodiment and fully enclosed in another embodiment.

In accordance with the aforementioned objects and those that will be mentioned and will become apparent below, a swim training fin according to the present invention comprising:

a fin having a proximal end and a distal end and having a dorsal section and a plantar section and defining an opening for insertion of a user's foot adjacent the proximal end;

the dorsal section having proximal and distal ends aligned with the proximal and distal ends of the fin, the dorsal section being solid from the proximal to distal ends and the dorsal section having side sections;

the plantar section having proximal and distal ends aligned with the proximal and distal ends of the fin and dorsal section; and the dorsal and plantar sections being joined, at least, at the proximal and side sections.

In an exemplary embodiment of the swim training fin according to the present invention, the plantar section is solid from its proximal to its distal ends thereby defining an enclosed fin.

In another exemplary embodiment of the swim training fin according to the present invention, each of the dorsal and plantar sections has a propulsive surface and the propulsive surface of the dorsal section is less than the propulsive surface of the plantar section.

In another exemplary embodiment of the swim training fin according to the present invention, the dorsal section has a fluid separator.

Also in accordance with the above objects and with those that will be mentioned and will become apparent below, the swim training fin according to the present invention comprises:

a boot made from pliable material, the material being of varying thickness;

the boot having a foot pocket and a blade portion, the foot pocket sized and shaped for removable attachment to the foot;

the blade portion sized and shaped for swim training purposes and for transmitting propulsive forces created by a user's leg to the foot and fin and the blade portion having a defined thickness; and the foot pocket having a constant thickness and being thinner than the thickness of the blade portion.

In other exemplary embodiments of the training fin according to the present invention, the training fin comprises:

a foot pocket defined by that portion of the fin being directly adjacent the user's foot when the user's foot is inserted into the fin and being sized and shaped for removable attachment with the foot of a user;

a blade portion sized and shaped for swim training purposes and for transmitting propulsive forces created by a user's leg to the foot, the blade portion having a plantar section and a dorsal section, each of the sections defining a propulsive area, the dorsal propulsive section being approximately one-half the area of the propulsive section of the plantar section.

In another exemplary embodiment, approximately half of the area of the dorsal section comprises propulsive area. Additionally, the ratio of the propulsive area of the plantar section to dorsal section is approximately 2:1.

An advantage of the present invention is that a substantial majority of swimmers can gain the benefits of a swim training fin without having to have the ankle flexibility required to benefit from earlier fin designs.

Another advantage of the present invention is to provide a swim training fin that is hydrodynamic and decreases drag over previous swim training fins.

Another advantage of the present invention is to provide a swim training fin that at least substantially encloses the foot to provide greater hydrodynamic characteristics.

Another advantage of the present invention is to provide a swim training fin that effectively assists the world class swimmer in his/her training regimen.

BRIEF DESCRIPTION OF THE DRAWING

For a further understanding of the objects and advantages of the present invention, reference should be given to the following detailed description, taken in conjunction with the accompanying drawings, in which like parts are given like reference numerals and wherein:

FIG. 2 is a side plan view, while FIG. 3 is a side perspective view.

DETAILED DESCRIPTION OF THE INVENTION

There is perhaps no exercise that gives a person as many benefits as swim training. It is well known that the average person can achieve great cardiovascular and other exercise benefits from swim training. Likewise, it is well known that swim training utilizes virtually all of the muscle mass while performing propulsive movements. This includes performing breathing movements and coordinating those movements with the propulsive movements and other muscle activity.

Not only does a swimmer get a cardiovascular workout while swimming, the swimmer must stabilize his/her core and maintain balance as he/she travels through the water. The body core muscles continually stabilize the body, resisting forces that would disturb streamlining as well as transmitting propulsive forces from the upper body and the legs. As a result of this type of exercising, superior cardiovascular conditioning, muscle toning and enhancement of flexibility are possible.

Additionally, swimming is low impact on most parts of the body. For example, while running on a track, even a dirt or composition track, the body is pounded on each separate step. Throughout the entire run, the body takes punishment with no relief. The only part of the body to be likely to be injured during swimming are the shoulders. However, as long as the swimmer is not attempting to overwork the shoulders, even the shoulders are not at risk.

Using the swim training fin as described herein, the swimmer need not overwork the shoulders. The swimmer gets the benefit of being able to train at a fast pace or even a race pace without coming close to overworking the shoulders. This allows even causal swimmers to get the maximum advantage to their swim work outs. World class athletes, such as Olympians and Triathletes can get their needed cardiovascular workout while also benefiting from race pace coordination without being concerned about injury.

The swim training fin in accordance with this invention provides the swimmer of all levels the ability to increase their pace in the water while maintaining the necessary balance to provide a cardiovascular work out. Unlike earlier fins, there is less drag on the present invention and no longer the necessity to require the swimmer to have a particularly flexible ankle.

Figure 9:
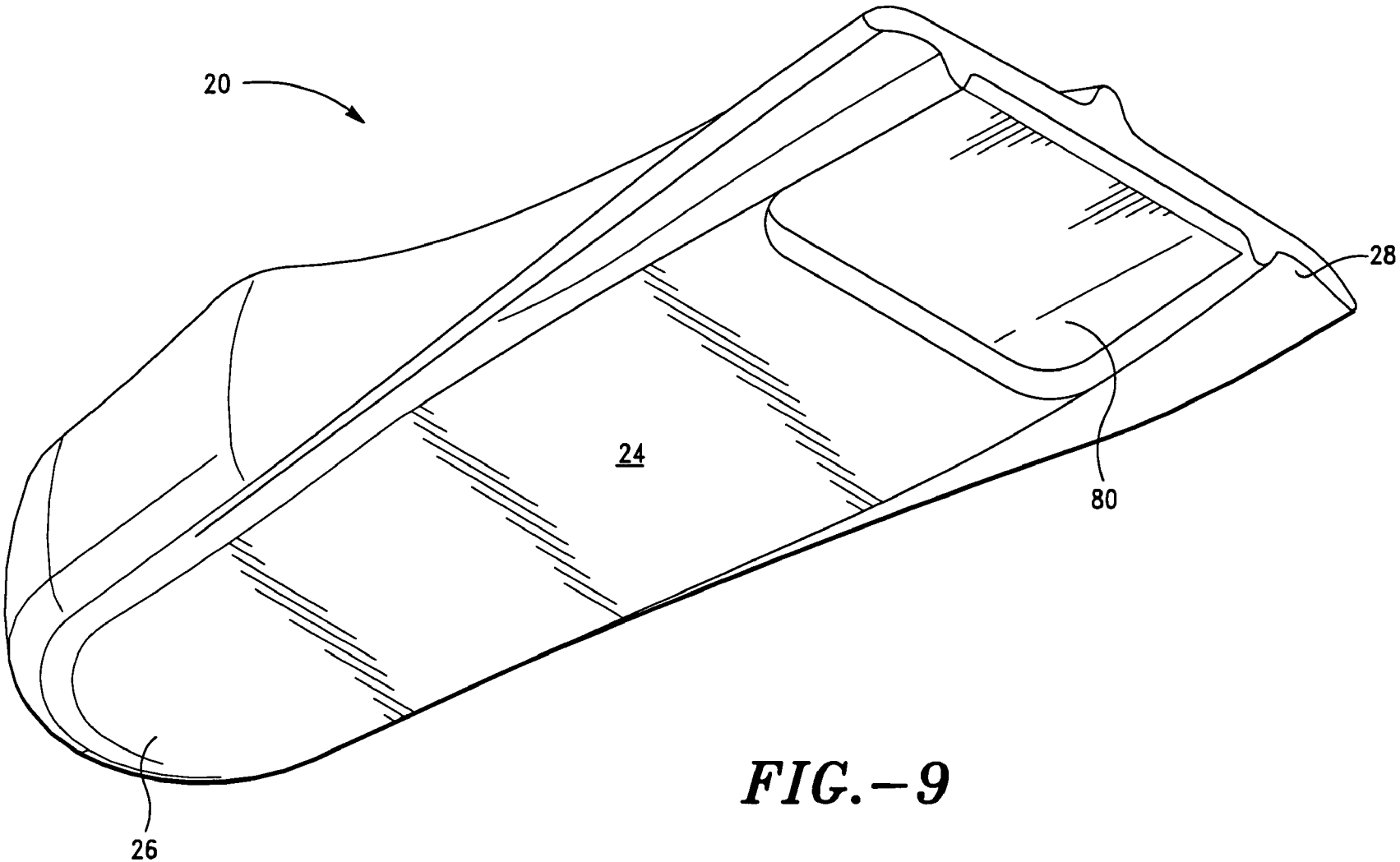
FIG. 9 illustrates the plantar section of an exemplary embodiment of the swim training fin in accordance with this invention.
Figure 10:
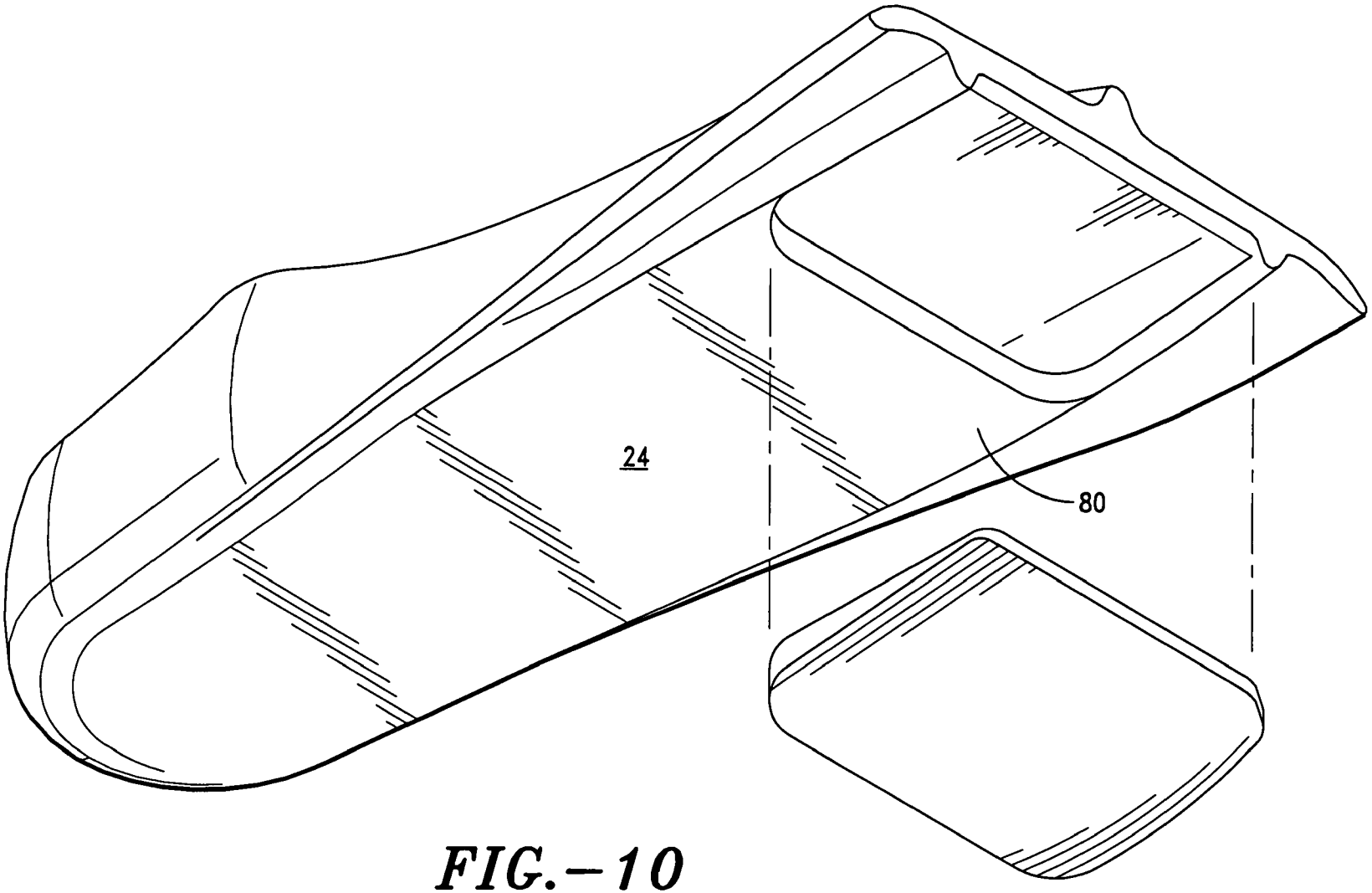
FIG. 10 illustrates another exemplary embodiment of the swim training fin in accordance with this invention.

With particular reference to the exemplary embodiment shown in FIG. 1, the invention will now be described wherein numeral 20 generally indicates the swim training fin in accordance with this invention. The fin 20 has a dorsal section 22 and a plantar section 24 (FIGS. 9 and 10). The fin has a proximal end 26 and a distal end 28. Adjacent the proximal end is an opening 30 for insertion of a user's foot (not shown).

Figure 1:
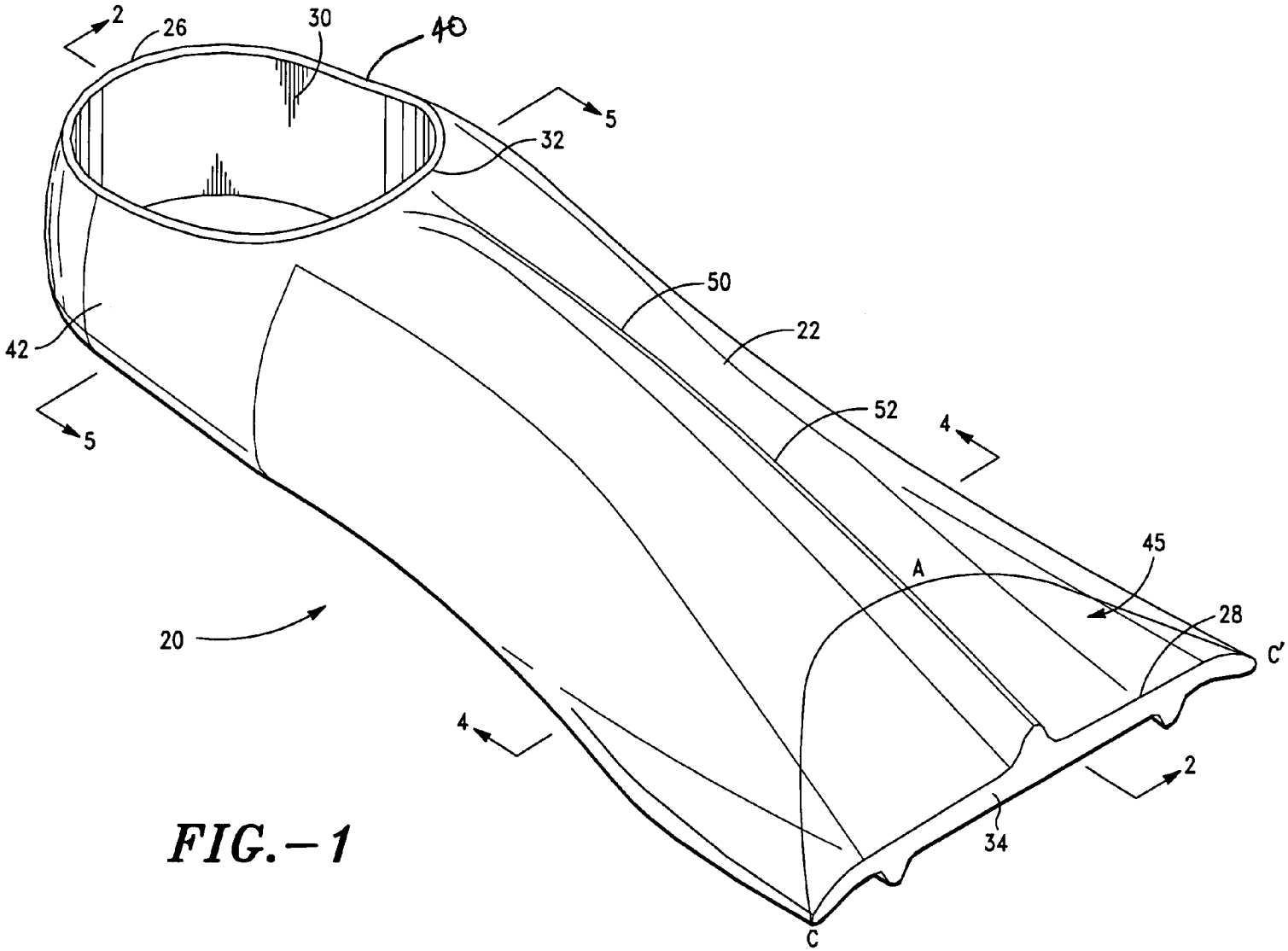
FIG. 1 is a perspective view of the swim training fin in accordance with this invention.
Figure 2:
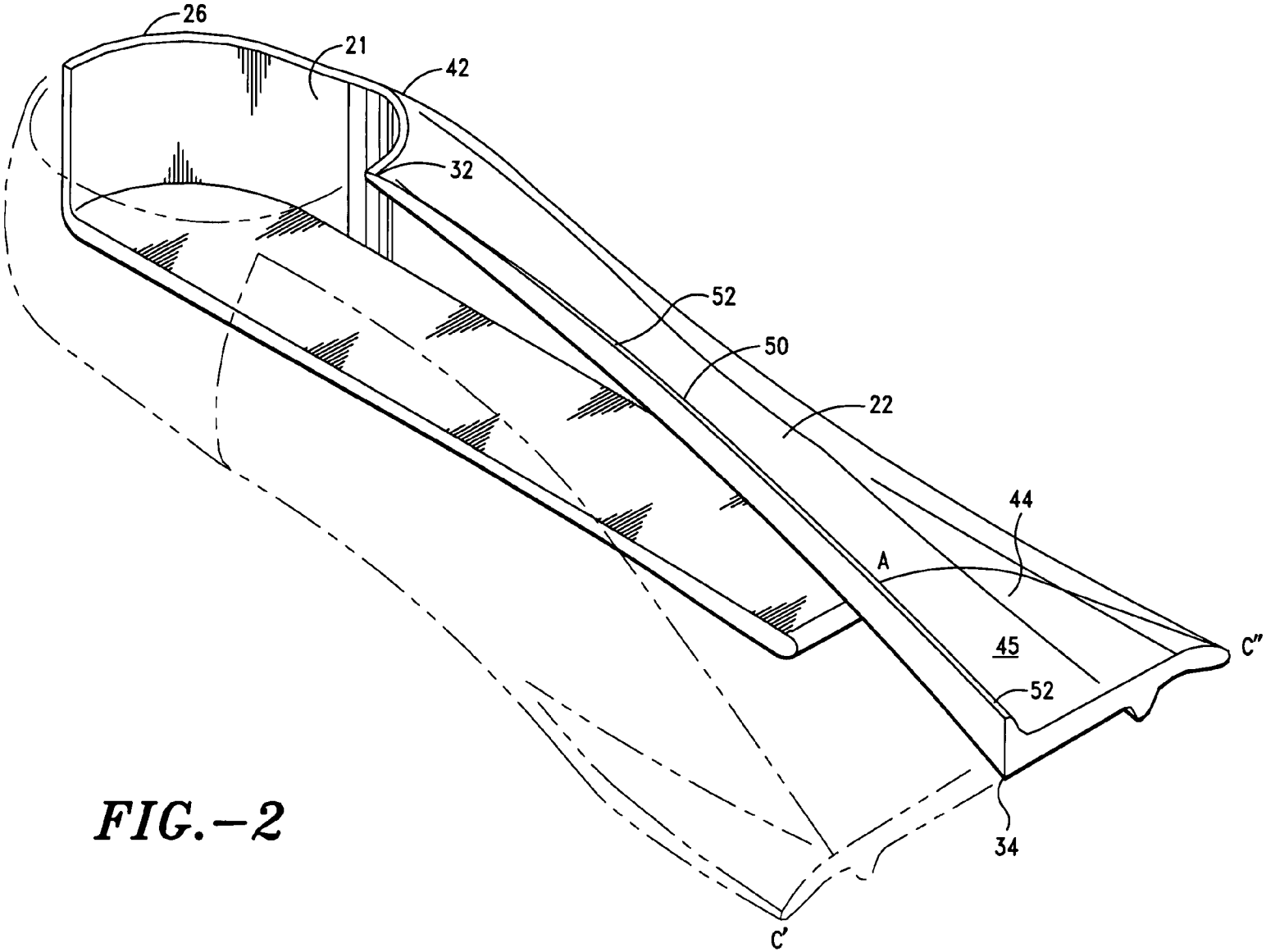
FIGS. 2 and 3 are side cut away view drawn substantially along line 2-2 of FIG. 2 and looking in the direction of the arrows.
Figure 3:
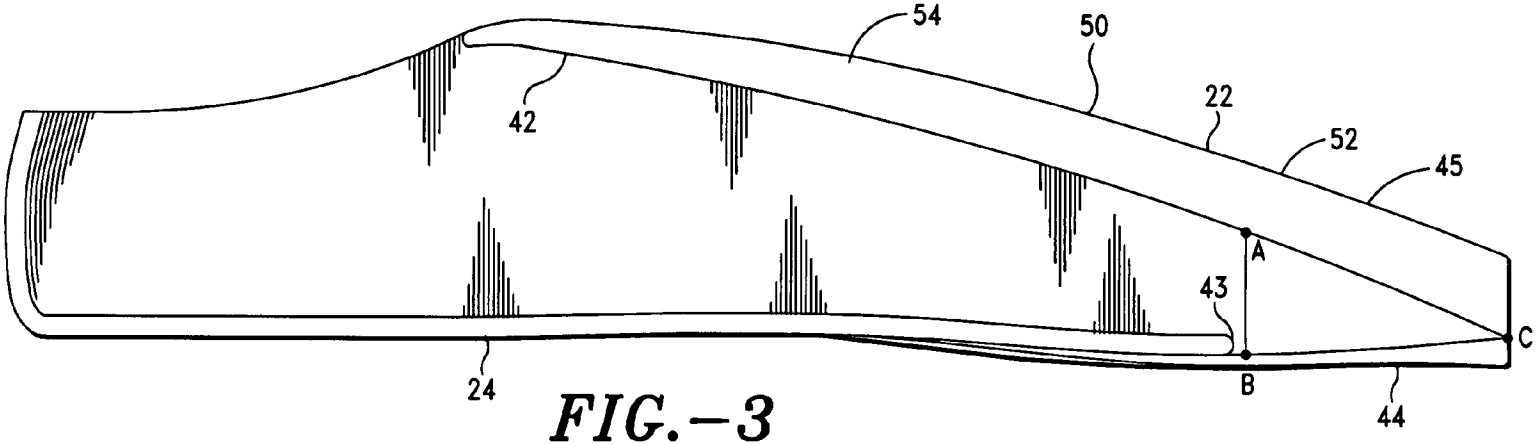
Figure 5:
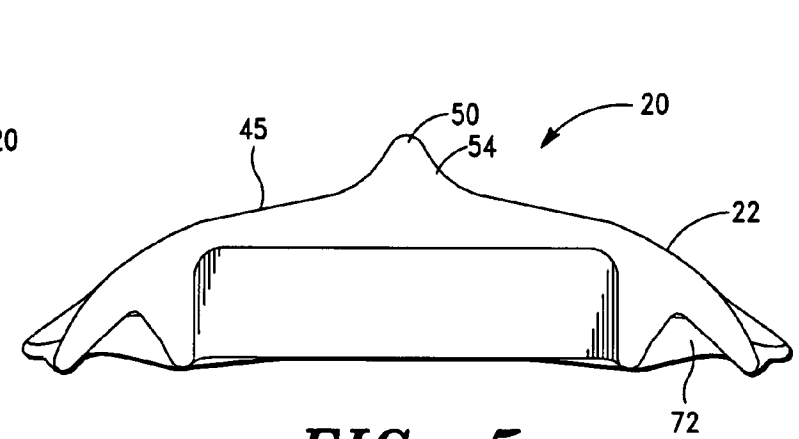
FIGS. 4 and 5 are side views of the swim training fin in accordance with this invention drawn along lines 4-4 and 5-5, respectively.

The fin 20 defines a boot 40 as shown in FIGS. 1-3. The boot 40 is sized and shaped for compatible fit with a user's foot. The boot 40 has a foot pocket 42 and a blade portion 44. Since the exemplary embodiment is an integral (single) piece of pliable material such as natural rubber, synthetic rubber or other pliable thermoplastic material, there is no definitive clear line of demarcation between the blade portion 44 and the foot pocket 42. Rather depending on the particular user, the foot pocket extends from the proximal end of the fin 26 until the area proximate the toes. In the exemplary embodiment shown in FIGS. 2 and 3 the foot pocket 42 proximal end shares the proximal end 26 of the fin 20, while the distal end of the foot pocket is denoted by numeral 43.

The boot material is of varying thickness to determine both comfort and the amount of deflection of the fin during use. In an exemplary embodiment, the thickness of the material of the foot pocket 42 is constant, while the thickness of the blade portion 44 varies. Also the thickness of the foot pocket 42 is generally thinner than that of the blade portion 44. In another exemplary embodiment, the foot pocket 42 is of varying thickness.

The blade portion 44 varies to assist in determining the precise amount of deflection the blade portion 44 will have in both the plantar and dorsal directions. In particular, in an exemplary embodiment, the thickness of the pliable material is thickest at the proximal end and thinnest at the distal end. This increases the amount of deflection of the fin 20. However, other aspects discussed above and below also significantly influence the amount of deflection of the fin 20 during use.

In particular, the foot pocket 42 is made from pliable material and having a thickness in the range of between 3 mm and 10 mm. The thickness of the pliable material for the blade portion 44 ranges from 5 to 10 mm. Both the blade portion 44 material and the wings 70 material have a thickness of more in the range of 7 to 8 mm most areas. Material thickness of the wings 70 again is, at least in part, determined by the slope of the streamlining surface and also by the need for rigidity. With this as the framework, by modifying the durometer of material in different areas and by molding the plantar surface to be open or solid, one can exert the desired control of resistance to deflection as will be explained in more detail with respect to FIGS. 9 and 10. Typically, the durometer of the pliable material in the exemplary embodiment is 50-70.

Additionally, as will be more fully appreciated hereinafter, the propulsive section of the fin 20 begins where the foot pocket 42 ends, namely at the area adjacent and proximal to the distal end of the foot pocket, specifically at the area generally indicated by numeral 45.

Consequently, the blade portion 44 begins where the foot section 42 ends. As will be explained in detail below the blade portion 44 comprises the propulsive area of the fin 20.

The dorsal section 22 has a proximal end 32 and a distal end 34. As shown in the drawing, the dorsal section 22 is solid from its proximal end 32 to its distal end 34. This facilitates hydrodynamic streamlining and dramatically reduces the drag on the fin as user swims.

FIGS. 1-3 also show the slope of the dorsal section 22. As will appreciated from the drawing, the plantar section 24 is relatively flat while the dorsal section 22 slopes toward the plantar section 24 as one views the cross section of the fin 20 from the proximal end 32 of the dorsal section 22 to its distal end 34, most particularly in FIGS. 2 and 3.

At terminus of the foot, when the user's foot is inserted in the fin 20 (the end of the toes of the user), a line A-B can be drawn which intersects both the dorsal and plantar section, 22 and 24, respectively, at the terminus of the foot. Also, at the intersection of the dorsal and plantar sections, 22 and 24, respectively, a line C-C' can be drawn along the distal end of the fin (FIG. 1). In cross section, as shown in FIGS. 2 and 3, an angle ABC can be formed which accurately approximates, the slope of the dorsal section. It has been found that when angle ABC equals approximately 18° swimmers of virtually all ankle flexibilities can obtain the benefits of the swim training fin in accordance with this invention.

As will be more fully appreciated hereinafter, the distal end of the fin 20, as a result of the up and down movement through the water by the kicking of the swimmer's legs to generate propulsion, deflects allowing for greater propulsion and less hydrodynamic drag. The amount of deflection by the fin 20 is greater than the earlier training fins and allows for greater propulsion. For this and other reasons, as will be appreciated more fully hereinafter, a swimmer with an ankle flexibility of less than 60° can obtain the enhanced exercise benefits of using the swim training fin in accordance with this invention.

Also, as seen in FIGS. 1-3, an arc C'AC" (FIG. 1) can be inscribed extending from one side of the distal end 34 of the dorsal section at point C', through point A to the other side of the dorsal section 22 at point C". The area inscribed by the arc C'AC" represents the propulsive surface of the dorsal section 22 and is generally depicted by numeral 45. The remaining area of the dorsal section 22 comprises the streamlining area.

As will be more fully appreciated hereinafter by properly balancing the ratio of the propulsive area of the plantar surface to the propulsive area of the dorsal surface, the fin 20 will produce propulsion in both the up and the down stroke. The amount of deflection produced, as will be more fully appreciated hereinafter, will determine the efficiency of the use of the fin and the benefits derived from its use.

The dorsal section 22 includes a fluid separator 50, which is clearly seen in FIGS. 1-8. With particular reference to FIGS. 2 and 3, there is shown the fluid separator 50 rising above the surface of the dorsal section 22. The fluid separator has a central leading edge 52 which extends from the proximal end 32 to the distal end 34 of the dorsal section. The fluid separator 50 separates the water moving past the fin into two paths. By doing this lateral forces will not be exerted upon the fin 20 as they would be on a single angled surface. This adds significantly to the hydrodynamic streamlining functionality of the fin and the overall ability of swimmers to use the fin 20.

Water is shed from the dorsal section 22 either laterally, along the streamlining surface area or propulsively in a direction diametrically opposite from the swimmer's direction along the propulsive surface area. This water passes with lowered resistance laterally from the fin. This facilitates hydrodynamic streamlining and dramatically reduces the drag on the fin in an area of the fin that would otherwise produce a substantial amount of drag, but not propulsion. This promotes a substantial improvement in reduced drag and fin efficiency by the fin 20 over previous swim training fins.

Also as shown the fluid separator is symmetrically located on the fin 20, longitudinally bisecting the dorsal propulsive surface. Along the propulsive surface of the dorsal section, the central leading edge no longer functions as a fluid separator, but rather as a stiffener 54 to reduce the amount of deflection of the fin 20 while in use.

The stiffener 54 meets the dorsal propulsive surface at a relatively steep angle. In an exemplary embodiment, shown in FIG. 8, the stiffener 54 has a radius on the leading edge so it does not cause turbulence. The side of the of the fin defines side walls which are generally perpendicular to the dorsal propulsive surface. In the exemplary embodiment, the side wall makes an angle of between 80° and 85° relative to the dorsal propulsive surface. This is clearly seen in FIG. 4, where the gentle curving slope of the fluid separator 50 meets the dorsal streamlined section. This stiffener 54 serves to variably stiffen the dorsal propulsive section. The stiffener will increase resistance against upward deflection by downward kicking forces. Water passing in the area of the dorsal propulsive section 45 is deflected off the distal end of the dorsal section 34, producing propulsive forces.

For a swim training fin to act as such and produce efficient propulsion, the plantar and dorsal propulsive surfaces must be able to be quickly positioned to generate propulsion and must continue to produce propulsion as deflection forces increase. The inability of a user to properly position either propulsive surface would discourage use of the fin and would be the result of inadequate fin design. Excessive deflection of either the dorsal or plantar propulsive surfaces when the fin is under load would result in a sudden loss of propulsion.

Figure 4:
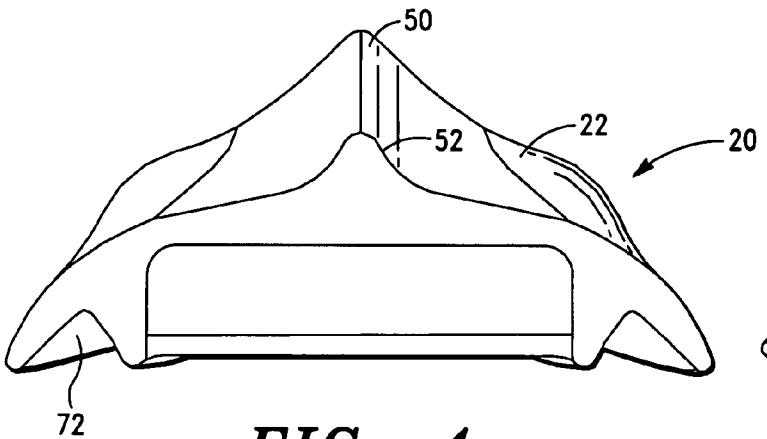
Figure 8:
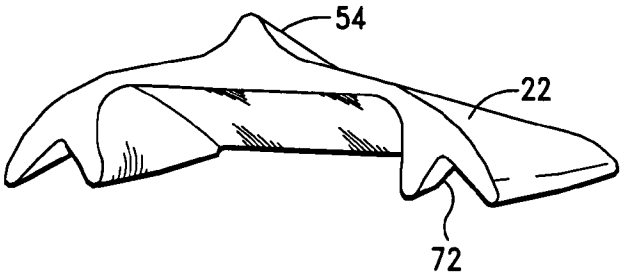
FIGS. 6-8 are sectional views of the swim training fin in accordance with this invention.
Figure 7:
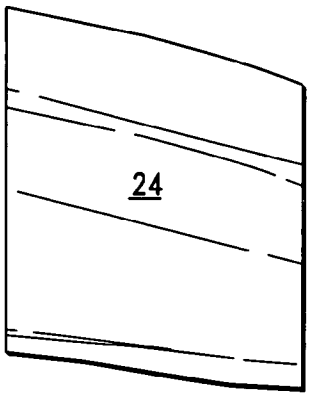

With particular reference to FIGS. 4-8, there is shown the fin 20 in sectional views. FIG. 4. Illustrates the rearward view of the cross section of the fin 20 in FIG. 1. The gentle slope of the fluid separator 52 with the dorsal section 22 is clearly shown. This is in contrast to the sharp slope that the stiffener 54 makes with the dorsal section 22 at the propulsive area 45 as clearly illustrated in FIG. 5. The same is likewise illustrated in FIGS. 6 and 8. FIG. 7 shows the plantar section between the slices of the dorsal section 22 of FIGS. 6 and 8. Thus, despite the fact that, as will be explained in more detail with respect to the description of the plantar section 24 of FIGS. 9 and 10, the plantar section 24 has an opening, there is still the same amount of propulsive surface from the plantar prospective. Either the foot will provide the surface or the underside of the dorsal section will serve that function. The opening in the plantar section does not lessen the amount of propulsive area for the plantar section 24. The opening there changes the deflection characteristics of the fin 20 as the fin is moved up and down during propulsion in the water.

Figure 6:
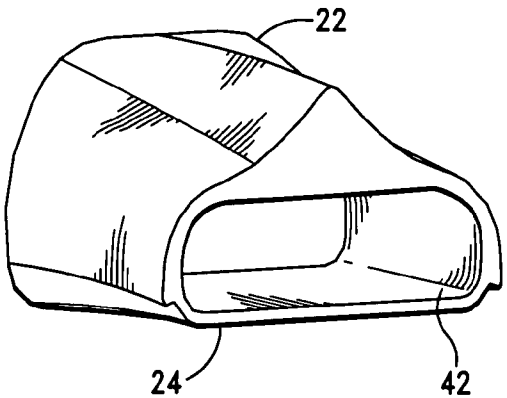

The section shown in FIG. 6 illustrates the distal end of the foot pocket 42. The user's foot is inserted in the fin opening 21 and the foot pocket 42 is formed by the dorsal and plantar sections 22 and 24. Also, as shown clearly in FIG. 6, the fluid separator 50 rises above the surface of the dorsal section 22, in cross section. And additionally, the beginning of the wing members 70 is formed by the juncture of the dorsal and plantar sections, 22 and 24 respectively, as shown.

The wing members 70 form a "V"-shaped opening 72, as clearly shown in cross section in FIGS. 4-6 and FIG. 8. Additional deflection resistance comes from the wings 70 which serve as two shear resisting membranes offset at 90° to form a stiffening V-shaped member. Simple changes in the durometer of material used in the V-shaped members during the molding process provide additional control of resistance to deflection.

Virtually all users of swim training fins are able to position the plantar surface of the fin to whatever angle of attack against the water feels most suitable. The range of motion of the foot required to accomplish adequate positioning of the plantar propulsive surface falls within the normal range of virtually all people. Therefore, in all embodiments, the plantar surface is intended to resist significant deflection.

What constitutes adequate or excessive deflection of the propulsive surfaces is a function of the user's ankle range of motion. To produce propulsion on the downward kicking movement, the dorsal propulsive surface must be able to deflect water in a rearward direction. For the user with more than 60° of ankle range of motion, the dorsal propulsive section need not be deflected at all to begin to produce propulsion. Merely initiating the downward kicking movement immediately generates propulsion. A very stiff embodiment is ideal for this user.

With particular reference to FIG. 9, there is shown the plantar section 24 in prospective view. The plantar section 24 has proximal and distal ends aligned with the proximal and distal ends, 26 and 28 of the fin 20. The dorsal section 22 and the plantar section 24 are joined at the sides and the distal end 28. Together with opening 21, the foot pocket 42 is defined.

The plantar section 24 has a propulsive section. The propulsive section of the plantar section 24 is defined by that part of the plantar section which is distal to the terminus of the toes in a manner similar to that described with respect to the dorsal section propulsive area. However, as is well understood by those skilled in the art, the propulsive surface of a particular fin plantar section is not limited strictly to the above definition. Any part of the plantar surface, exclusive of the foot portion, which assists the swimmer in moving forward in the water, clearly defines the propulsive surface as well. As shown clearly in FIGS. 9 and 10, the wing members 70 having V-members 72 are defined by the junction of the dorsal and plantar sections, 22 and 24, respectively.

The embodiment shown in FIG. 9 allows a maximum amount of deflection as compared with the embodiment of the fin 20 shown in FIG. 10. The distal end of the plantar section 24 has an opening 80 defining a plantar deflection opening. As will be appreciated, in comparison to the embodiment of FIG. 10, it is much easier to deflect the distal end of the fin during use. Clearly, the fin of FIG. 10 is much stiffer than the fin of FIG. 9 and consequently much more difficult to deflect in use.

Thus, as is appreciated by those skilled in the art, the amount of deflection is adjustable. Additionally, the deflection of the fin 20 is adjustable by changing the durometer of the material making up the dorsal and plantar section. The deflection of the fin 20 is also adjustable by varying the durometer and/or thickness of the materials making up the plantar and dorsal sections.

It will be appreciated that the above are examples only and many other combinations may be used. The interaction of thickness of material, durometer of material and the shape of the structural elements determine the attributes of the fin.

If the fin, as illustrated in FIG. 9, is molded with an open bottom and a durometer of 60, the dorsal propulsive surface will deflect 10 to 20° under moderate to heavy load and the plantar surface will deflect for 5 to 10°.

As discussed above, various factors effect the amount of flexion of the fin. For example, with a durometer of 60 and a solid bottom, FIG. 10, the dorsal propulsive surface flexes 5° to 10° under moderate to heavy load. The plantar surface flexes 3° to 5°. The difference in flexion is due in part to the increased differences in downward deflection of the plantar surface as a result of the arched shape of the underside of the dorsal propulsive surface. Additionally, there are anatomical reasons for resistance to deflection. The higher leg muscle forces are available during the downward kicking movement, more specifically the action of the quadriceps muscle in straightening the leg cause greater flexion.

It has been found that when molded with an open bottom at durometer 50, the dorsal propulsive surface will deflect 20° to 30° but the plantar surface will be in the 5° to 10° range due to the stiffening elements of the fin.

For the swimmer with approximately 60° of ankle range of motion, the dorsal propulsive section is propulsive at the inception of the downward kicking movement. However, as the fin moves downward, propulsion tends to drop unless the user is able to deflect the dorsal propulsive surface upward more. Adjustments in the molding process make this deflection controllable so this category of user can successfully deflect the dorsal propulsive section of fin 20 to continue to produce propulsion as the downward kicking movement progresses without experiencing excessive deflection of the dorsal propulsive section which would result in propulsive failure, e.g. no additional propulsion for leg movement.

For the swimmers with less than 60° of ankle range of motion, no propulsion from the downward kicking movement occurs until after the dorsal propulsive section has been deflected. The dorsal section must deflect quickly under moderate kicking forces, but must also have a limit to the amount it will deflect so the fin does not fail.

The fin 20 facilitates control of the deflection resistance of the plantar and dorsal propulsive sections by simple adjustments in the molding process as set forth above, allowing for more or less deflection to suit the specific needs of the user.

In Use:

Angle of Attack:

The general range for angle of attack for a swimmer is between 25° to 35° above the horizontal provides efficient sustainable propulsion. A 25° angle of attack causes more drag but produces more forward movement per kicking cycle than a 35°. As the swimmer changes the angle of attack below this general range, drag increases rapidly and propulsion falls. As swimmer approaches a 35° angle of attack, considerably less drag is encountered, but there is not as much propulsion for each kicking cycle. As the swimmer changes the angle of attack above this range, propulsion and drag decrease rapidly.

The following examples view a swimmer from the side view swimming in freestyle or the crawl stroke. The various categories of swimmers are based on ankle range of motion and are established in the following manner. When the leg is horizontal in the water and the foot is fully plantar flexed, the dorsal surface of the foot forms an angle relative to the horizontal plane, the following examples are based upon this angle.

The 60° Ankle Range of Motion Swimmer:

Taken from a side view as this particular swimmer is moving horizontally, parallel with the water surface, when the foot is flexed 60°, the dorsal surface of the foot will be parallel with the water surface. This is the correct mid-point because it is neutral. Movement of the foot at this angle does not produce propulsion nor does it impede forward progress. For each degree the foot flexes past 60°, more propulsion is generated because more water will be deflected rearward. For each degree the foot is short of flexing to 60°, more drag is caused. In fact, for swimmers having an ankle range of motion below 60°, it is believed that the the mere presence of the foot impedes the swimmer's progress. There is little, if any, propulsion possible from this class on the downward kick when no fin is worn.

For all categories of swimmers, the hips are well below the surface as the swimmer swims but the foot begins the downward kicking movement from a position at or near the surface of the water. The leg must angle upward to place the foot in this starting position. This difference in elevation between the hips and the foot increases the angle of the dorsal surface of the foot above horizontal by approx. 10°.

The first aspect of the downward kicking movement involves the thigh moving downward and the knee bending slightly. The foot remains near the surface. This bending of the knee further increases the angle of the dorsal surface of the foot another 10° to 15° above horizontal. Therefore the starting position of the dorsal surface of the foot and therefore of the fin is at approx. 20° to 25° above horizontal. This is close to the ideal range.

As the foot begins to move downward, flexion of the fin moves the dorsal propulsive surface area 45 into the ideal range. The angle of the dorsal surface area 45 gradually decreases as the foot moves downward, but the flexing of the fin continues to deflect water rearward generating propulsion. To maintain propulsion, it is necessary for the user to flex the fin 10 to 15° as the foot moves downward. The fin design for this category of swimmer must allow flexion in this range when normal kicking forces are applied.

The dorsal propulsive section of the fin is angled upwardly at an additional 18° relative to the dorsal surface of the swimmer's foot. To reach 25° to 35° above horizontal range, the fin 20 must flex from between 2° to 17°.

The Less Than 60° Ankle Range of Motion Swimmer:

For example, In the case of the 45 degree swimmer, after the hip to surface difference and the knee bend are factored in, the dorsal propulsive surface beings in a position approximately parallel to the surface. The initial angle of attack is therefore zero. This swimmer must flex the fin 20 before any propulsion is gained. To maintain propulsion through the downward kicking movement, the dorsal propulsive surface area 45 of the fin must flex 20 to 30° under reasonable load. As with the other categories, as the foot moves downward, the angle of attack decreases. If kicking force is gradually increased, flexion of the fin 20 increases and propulsion is maintained. Swimmers intuitively control this force level so propulsion remains reasonably continuous. The fin must be able to flex far enough to provide propulsion for this class without over flexing.

The More Than 60° Ankle Range of Motion Swimmer:

For the more than 60° swimmer, for example the swimmer who has an ankle range of motion of 70°, the angle of the dorsal surface of the foot will be +10° due to the hip to water surface angle, +10° to 15° generated by the knee bend and an additional +10° for the additional 10° of ankle flexibility this category of swimmer has over the 60 degree benchmark. That totals 30 to 35° above the horizontal. This is an extremely favorable starting position for this swimmer. This ready access to the ideal angle of attack range gives this swimmer the option of bending the knee slightly less at the inception of the downward kicking movement which results in a substantial reduction in drag that would be caused by the leading surface of the thigh as the swimmer moves through the water. The moment the downward kicking movement begins, the fin begins to generate propulsion. Therefore, the fin 20 shown in FIG. 10 with no opening in the plantar propulsion surface is most suited for this category of swimmer. The flexion of the dorsal propulsive surface area 45 is quite resistant and flexes only between 5° to 10° range.

In each of the examples above, the stated angle of the dorsal surface of the foot is the angle this surface would assume at the beginning of the downward kicking movement. The angle relative to the horizontal decreases as the foot moves downward, generally resulting in less propulsion in the latter portion of the downward kicking movement and a gradual increase in drag. Some swimmers may wish to perform the movement for a shorter duration and will prefer a greater resistance. Other users may wish to have access to an easier movement that can be performed for longer. The variety of configurations of fin 20 made possible by the fin in accordance with this invention extends this option to users.

While the foregoing describes several embodiments of a swim training fin in accordance with the present invention, it is to be understood that the above description is illustrative only and not limiting of the disclosed invention. It will be appreciated that it would be possible for one skilled in the art to modify a number of aspects of swim training fin within the spirit and scope of the invention. Additionally, the specific dimensions and ratios set forth in the foregoing description are illustrative and may be modified within the spirit and scope of the invention. In particular, for example, there is are ranges of stiffness of the fin and consequent amounts of deflection that may be altered as needed to accommodate the strengths of the various users. Accordingly, the present invention is to be limited only by the claims as set forth below.

What is claimed is:

1. A swim training fin, comprising:

a fin having a proximal end and a distal end and having a dorsal section and a plantar section and defining an opening for insertion of a user's foot adjacent the proximal end;

the dorsal section having proximal and distal ends aligned with the proximal and distal ends of the fin, the dorsal section being solid from the proximal to distal ends and the dorsal section having side sections;

the plantar section having proximal and distal ends aligned with the proximal and distal ends of the fin and dorsal section;

the dorsal and plantar sections being joined, at least, at the proximal and side sections and;

wherein each of the dorsal and plantar sections have an end zone and the end zone defines a propulsive surface and wherein the propulsive surface of the dorsal section is less than the propulsive surface of the plantar section.

2. The swim training fin as set forth in claim 1, wherein the dorsal section has a fluid separator and apex of the fluid separator occurs proximate the highest point in cross section on the dorsal surface.

3. The swim training fin as set forth in claim 1, wherein the dorsal section is divided into a propulsive area and streamlining area for promoting a hydrodynamic dorsal section and for promoting a minimum amount of drag.

4. The swim training fin as set forth in claim 1, wherein the dorsal section and plantar side sections define hydrodynamic wing members for adjusting fin deflection.

5. The swim training fin as set forth in claim 1, wherein the plantar section has an open section adjacent the distal end.

6. The swim training fin as set forth in claim 1, wherein the plantar section is solid from its proximal to its distal ends thereby defining an enclosed fin.

7. The swim training fin as set forth in claim 2, wherein the fluid separator has a central leading edge and that central leading edge divides the fin dorsal section symmetrically and wherein a continuously sloping path runs from the fluid separator apex to the lateral border of the fin.

8. The swim training fin as set forth in claim 7, wherein fluid separator has a stiffening member.

9. A swim training fin removably attached to a user's foot, comprising:

a boot made from pliable material, the material being of varying thickness;

the boot having a foot pocket and a blade portion, the foot pocket sized and shaped for removable attachment to the foot;

the blade portion sized and shaped for swim training purposes and for transmitting propulsive forces created by a user's leg to the foot and fin and the blade portion having a defined thickness; and the foot pocket having a constant thickness and being thinner than the thickness of the blade portion.

10. The swim training fin as set forth in claim 9, wherein the thickness of the pliable material of the foot pocket is generally of constant thickness.

11. The swim training fin as set forth in claim 9, wherein the blade portion is of varying thickness.

12. The swim training fin as set forth in claim 10, wherein the blade portion has a proximal end adjacent the foot pocket and a distal end furthermost away from the foot section and the thickness of the pliable material varying with the thinnest portion at the distal end and the thickest portion at the proximal end.

13. The swim training fin as set forth in claim 9, wherein the foot pocket thickness is in the range of between 3 mm and 10 mm in areas which would be adjacent to the user's foot when inserted in the fin.

14. The swim training fin as set forth in claim 13, wherein the blade portion thickness is in the range of between 5 mm and 10 mm where the foot pocket joins the blade portion.

15. The swim training fin as set forth in claim 9, wherein the wing thickness is in the range of between 7 mm to 8 mm.

16. The swim training fin as set forth in claim 9, wherein the durometer of the blade portion is between 50 and 60.

17. The swim training fin as set forth in claim 9, wherein the wherein the durometer of the wings is between 50 and 70.

18. The swim training fin as set forth in claim 4, wherein the wing members define a V-Shaped member.

19. A swim training fin, comprising:

a fin having a proximal end and a distal end and having a dorsal section and a plantar section and defining an opening for insertion of a user's foot adjacent the proximal end;

the dorsal section having proximal and distal ends aligned with the proximal and distal ends of the fin, the dorsal section being solid from the proximal to distal ends and the dorsal section having side sections;

the plantar section having proximal and distal ends aligned with the proximal and distal ends of the fin and dorsal section;

the dorsal and plantar sections being joined, at least, at the proximal and side sections and;

wherein each of the dorsal and plantar sections have an end zone and the end zone defines a propulsive surface and wherein the propulsive surface of the dorsal section is less than the propulsive surface of the plantar section and wherein the deflection of the fin is adjustable.

20. The swim training fin as set forth in claim 19, wherein the foot pocket and the portion define a hydrodynamic shape for promoting the user's movement through the water.

21. The swim training fin as set forth in claim 19, wherein the surface area of the foot pocket and the surface area of the dorsal section are approximately equal.

22. The swim training fin as set forth in claim 21, wherein approximately half of the area of the dorsal section comprises the propulsive area.

23. The swim training fin as set forth in claim 9, wherein the ratio of propulsive area of the plantar section to dorsal section is approximately 2:1, plus or minus 10%.

24. A swim training fin removably attached to a user's foot, comprising:

a foot pocket defined by that portion of the fin being adjacent the swimmer's foot when the user's foot is inserted into the fin and being sized and shaped for removable attachment with the foot of a swimmer; a blade portion sized and shaped for swim training purposes and for transmitting propulsive forces created by a swimmer's leg to the foot, the blade portion having a plantar section and a dorsal section, each of the sections defining a propulsive surface area, the propulsive area each of the sections having a defined range of angle of deflection while the fin is in use defining flexion; the dorsal section being capable of flexion in the range of between 5° and 30° and plantar section being capable of flexion in the range of between 3° and 10°, and wherein the plantar section has an opening and the range of flexion for the dorsal section is between 10° and 30° and the plantar section range of flexion is between 5° and 10°.

25. The swim training fin as set forth in claim 24, wherein the swim training fin is made from pliable material and that material has a durometer of 60 and wherein the flexion of the dorsal section is between 10° and 20° and the plantar section has a range of flexion of between 5° and 10°.

26. The swim training fin as set forth in claim 24, wherein the swim training fin is made from pliable material and that material has a durometer of 50 and wherein the flexion of the dorsal section is between 20° and 30° and the plantar section has a range of flexion of between 5° and 10°.

27. The swim training fin as set forth in claim 24, wherein the plantar section is a single piece with no opening and wherein the range of flexion for the dorsal section is between 5° and 10° and the plantar section range of flexion is between 3° and 5°.

28. The swim training fin as set forth in claim 1, wherein propulsive surface defines an arcuate area at the end zone of the fin.

* * * * *